US008331831B2

(12) United States Patent
Aoki et al.

(10) Patent No.: US 8,331,831 B2
(45) Date of Patent: Dec. 11, 2012

(54) DEVELOPER CONTAINER PACKAGE BODY AND PACKAGE CONTAINER

(75) Inventors: Junichi Aoki, Kanagawa (JP); Naoto Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 218 days.

(21) Appl. No.: 12/856,080

(22) Filed: Aug. 13, 2010

(65) Prior Publication Data

US 2011/0069997 A1 Mar. 24, 2011

(30) Foreign Application Priority Data

Sep. 18, 2009 (JP) ..... 2009-216767

(51) Int. Cl.
*G03G 15/08* (2006.01)

(52) U.S. Cl. ..... 399/262; 399/107

(58) Field of Classification Search ..... 399/262, 399/110, 107
See application file for complete search history.

(56) References Cited

U.S. PATENT DOCUMENTS

| | | | | |
|---|---|---|---|---|
| 5,307,129 | A | 4/1994 | Miura et al. | |
| 8,033,447 | B2 * | 10/2011 | Katoh | 399/262 X |
| 2006/0191984 | A1 | 8/2006 | Hitosugi | |
| 2006/0193654 | A1 * | 8/2006 | Kamimura | 399/103 |

FOREIGN PATENT DOCUMENTS

| | | |
|---|---|---|
| JP | A-4-139469 | 5/1992 |
| JP | A-7-287429 | 10/1995 |
| JP | A-2005-99593 | 4/2005 |
| JP | A-2005-206242 | 8/2005 |
| JP | A-2007-178969 | 7/2007 |
| JP | A-2008-224877 | 9/2008 |

OTHER PUBLICATIONS

Japanese Office Action dated May 18, 2010 in Japanese Patent Application No. 2009-216767 (with translation).
Japanese Office Action dated Aug. 3, 2010 in Japanese Patent Application No. 2009-216767 (with translation).

* cited by examiner

*Primary Examiner* — Sophia S Chen
(74) *Attorney, Agent, or Firm* — Oliff & Berridge, PLC

(57) ABSTRACT

An end portion of a top side of a package container is tapered. Although a developer container package body may be stood up with a bottom side at the bottom, it cannot be stood up with the top side at the bottom. The bottom side serves as a switching lid of the package container. When the switching lid is opened, an opening which is a taking-out hole appears and a developer container can be taken out of the opening.

6 Claims, 12 Drawing Sheets

DEVELOPER CONTAINER PACKAGE BODY AND PACKAGE CONTAINER

CROSS-REFERENCE TO RELATED APPLICATION

This application is based on and claims priority under 35 USC 119 from Japanese Patent Application No. 2009-216767 filed on Sep. 18, 2009.

BACKGROUND

1. Technical Field

The present invention relates to a developer container package body and a package container.

2. Summary

According to an aspect of the invention, a developer container package body includes a developer container and a package container. The developer container accommodates a developer. The package container packages the developer container. With the developer container accommodated in the package container, the package container is able to be stood up on a horizontal plane with one end side in a longitudinal direction of the package container at the bottom, and is not able to be stood up on the horizontal plane with the other end side in the longitudinal direction of the package container at the bottom. The developer container includes an accommodating part, a conveying unit and a discharging port. The accommodating part accommodates the developer therein. The conveying unit conveys the developer contained in a body of the container as the conveying unit is rotated. The discharging port is provided in a downstream side of a conveyance direction of the conveying unit in the longitudinal direction of the container body, and discharges the developer out of the accommodating part. A side which has the discharging port of the developer container is located at the other end side of the package container and a side which does not have the discharging port of the package container is located at the one end side of the package container.

BRIEF DESCRIPTION OF THE DRAWINGS

Exemplary embodiments of the invention will be described in detail based on the following figures, wherein.

DETAILED DESCRIPTION

Hereinafter, one embodiment of the present invention will be described with reference to the drawings.

First, a developer container will be described.

Figure 1:
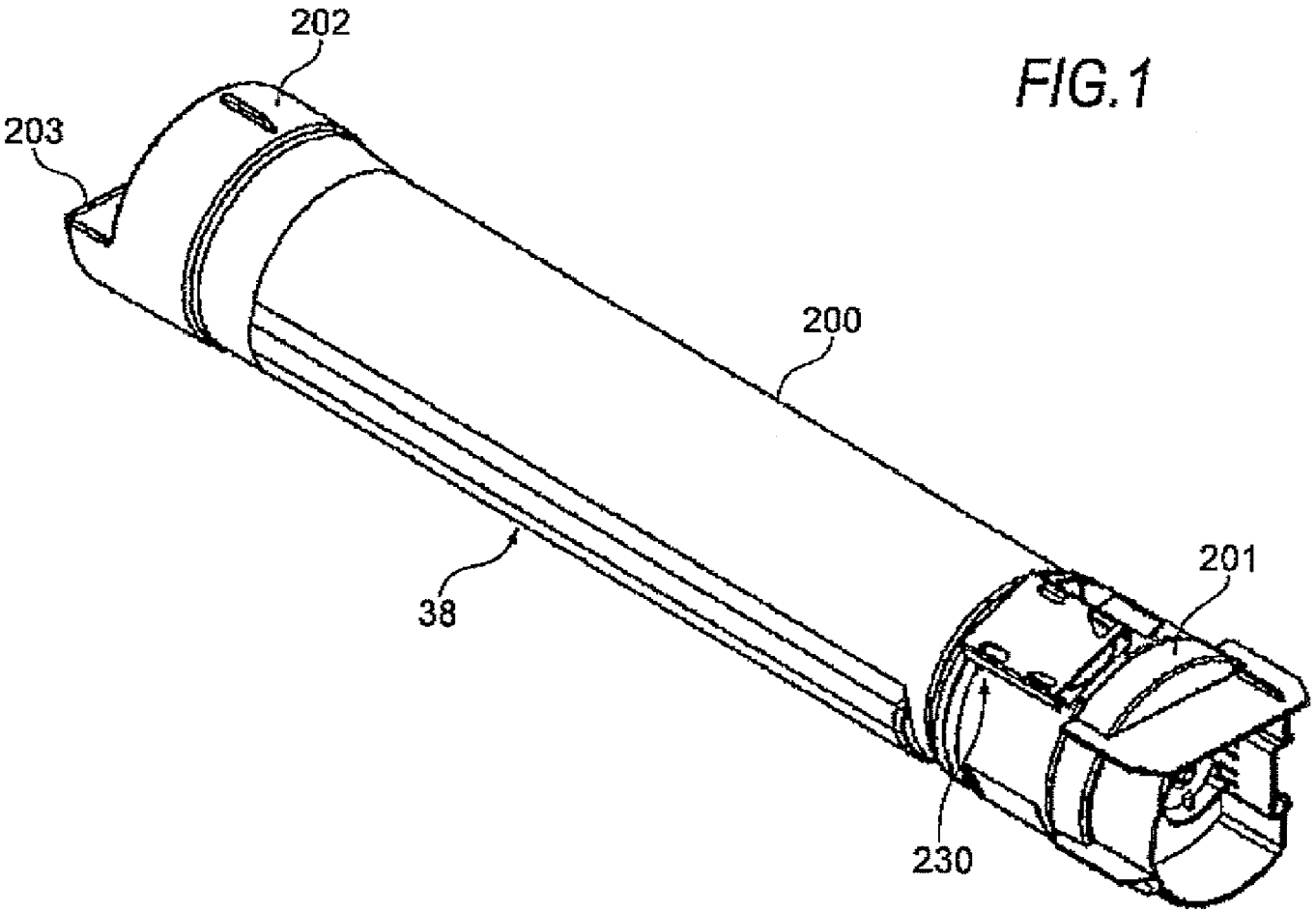
FIG. 1 is a perspective view of a developer container according to one embodiment of the present invention.
Figure 2:
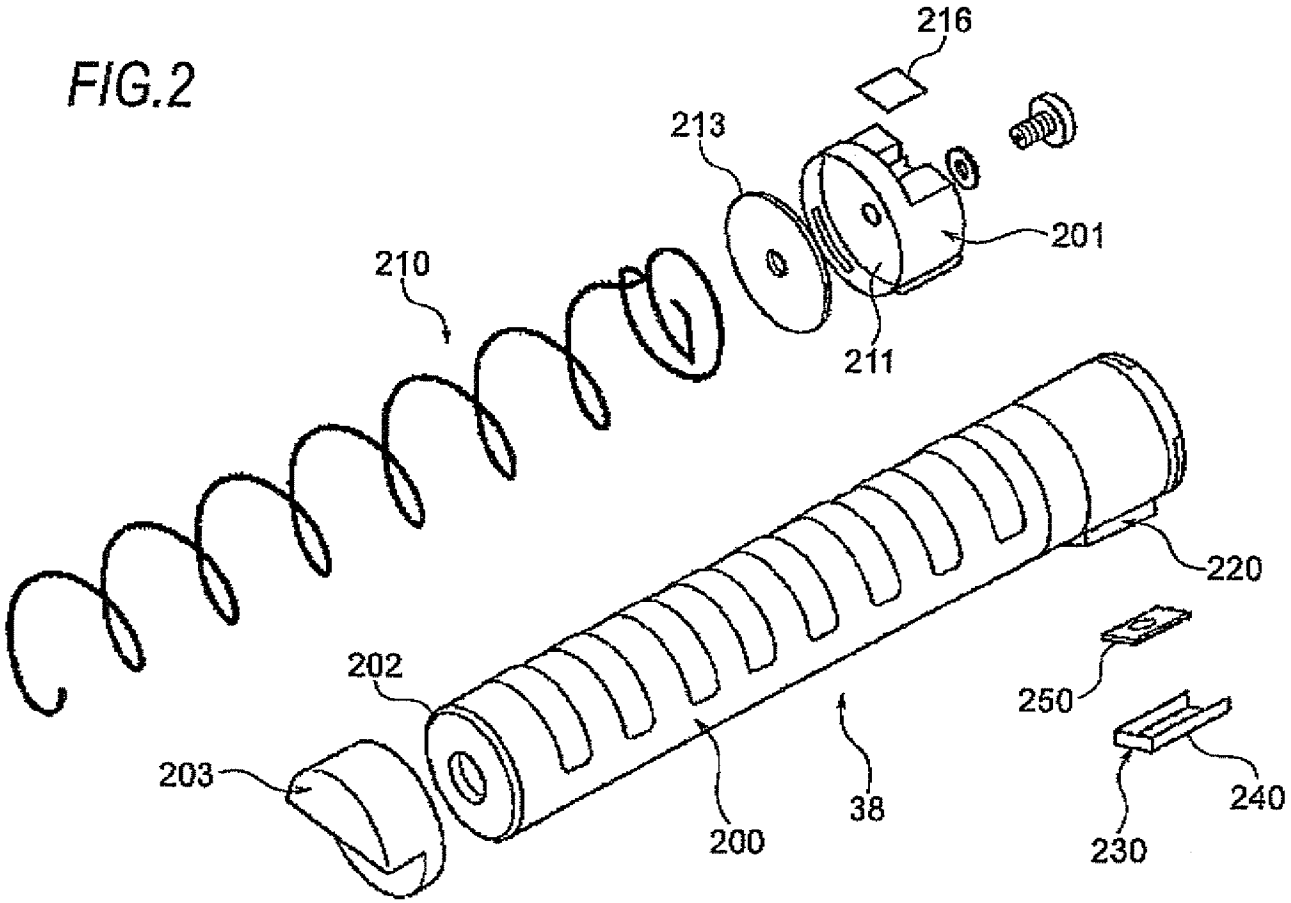
FIG. 2 is an exploded perspective view of a developer container according to one embodiment of the present invention.
Figure 3:
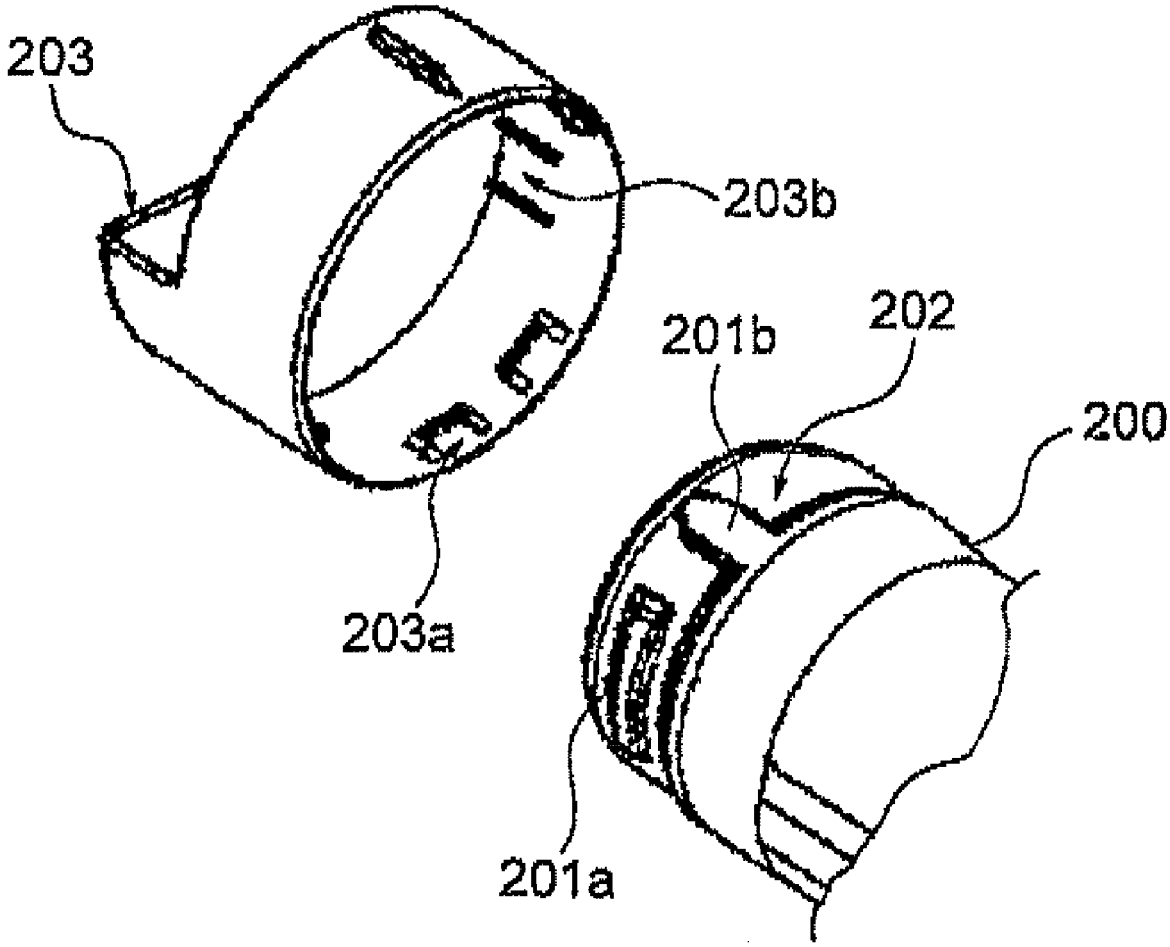
FIG. 3 is a perspective view of an end portion of a developer container according to one embodiment of the present invention.
Figure 4:
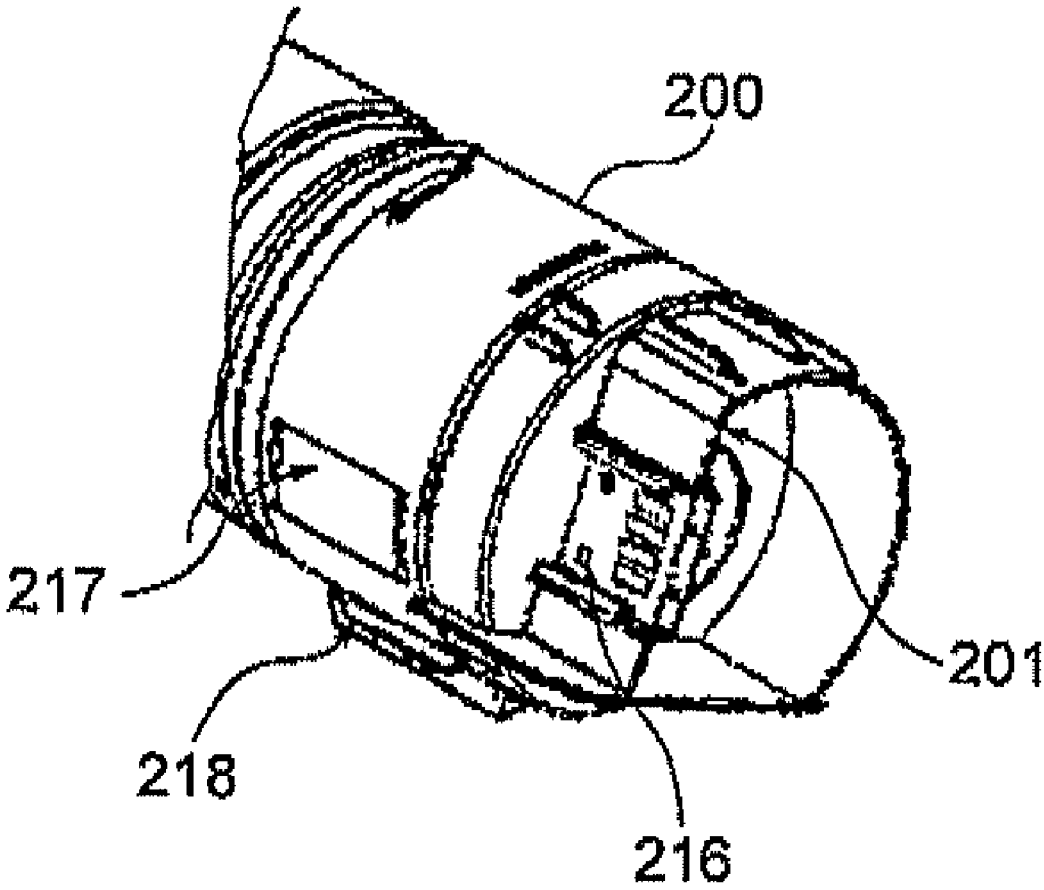
FIG. 4 is a perspective view of an end portion of a developer container according to one embodiment of the present invention.
Figure 5:
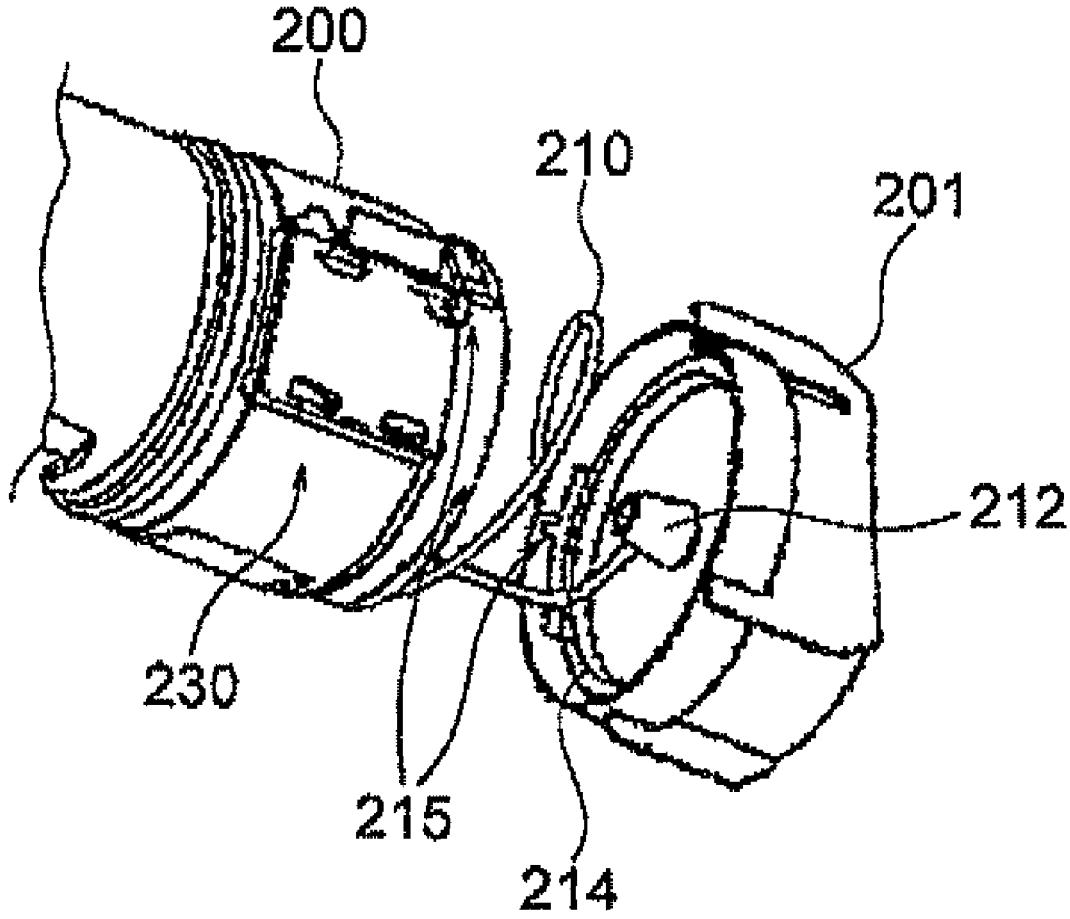
FIG. 5 is a perspective view of a state where one end flange of a developer container is detached according to one embodiment of the present invention.
Figure 6:
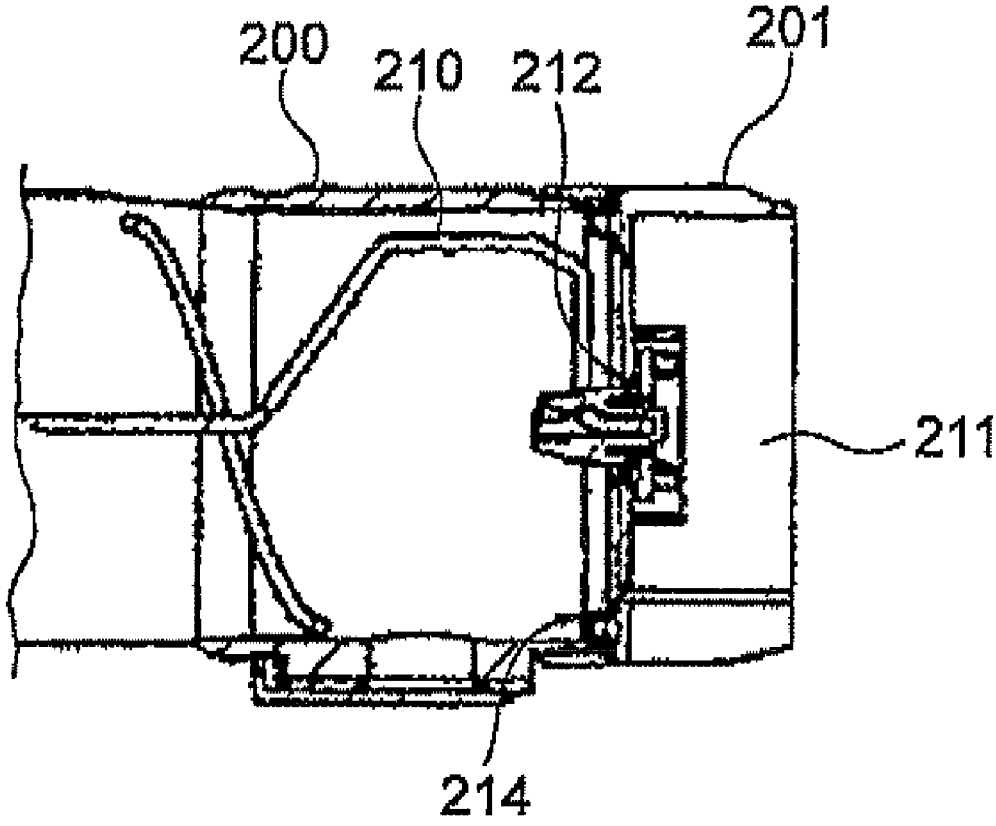
FIG. 6 is an explanatory view of an example of a structure of attachment of an agitator of a developer container to an end flange according to one embodiment of the present invention.

FIG. 1 is a perspective view of a developer container and FIG. 2 is an exploded perspective view of the same. FIGS. 3 and 4 are perspective views of an end portion of the developer container. FIG. 5 is a perspective view of a state where one end flange of the developer container is detached. FIG. 6 is an explanatory view of an example of a structure of attachment of an agitator to an end flange.

A developer container 38 is a container which accommodates a developer (toner or the like) for forming an image according to an electro-photographic method, is loaded into an image forming apparatus such as a copier, a printer or the like for performing an image forming operation according to the electro-photographic method, and supplies the developer to a developing unit accommodated within the image forming apparatus.

The developer container 38 includes a cylindrical container body 200, which is a long accommodating part having both opened ends shaped from synthetic resin such as, for example, ABS, PET or the like, by a drawing blow, an agitator 210 disposed therein, which is a discharge part which can agitate the developer accommodated in the container body 200, and end flanges 201 and 202 mounted respectively at both ends of the cylindrical container body 200.

In this case, one end flange 202 is provided with a holding handle 203. As shown in FIG. 3, the holding handle 203 is fitted on one end flange 202, an elastic holding piece 203*a* for falling-out prevention is engaged with and held by a stepped portion 201*a* of the end flange 202, and a positioning step 201*b* of the end flange 202 is fitted in a rotation prevention concave portion 203*b* for positioning.

In addition, as shown in FIGS. 2, 5 and 6, the other end flange 201 is provided with a rotor 211 connected with a driving shaft of an external driving source of an image forming apparatus (not shown), and an engagement part 212 engaged with and supported by a shaft portion of the agitator 210 is provided in the inner center of the rotor 211. In addition, a seal member 213 is interposed between the end flange 201 and the container body 200, and a ring-like seal member 214 to seal between the rotor 211 and the end flange 201 is interposed therebetween. In addition, reference numeral 215 denotes a rotation prevention part which is interposed between the other end flange 201 and the container body 200 and is defined by fitting of a projection with a groove.

In addition, as shown in FIG. 4, the other end flange 201 is attached with a usage history management memory 216 which is connected so as to be able to communicate with a controller of an image forming apparatus and stores usage history of the developer container 38. In addition, reference numeral 217 denotes a holding surface of the container body 200 during assembly or when filling developer and reference numeral 218 denotes a rotation prevention part when attaching the end flange 201.

In addition, a discharge opening 220 as a discharging port is opened near one longitudinal end of a circumferential wall of the cylindrical container body 200 (at a side of the end flange 201) and a shutter 230, which is a switching mechanism to switch the discharge opening 220, is disposed in the discharge opening 220. Reference numeral 240 denotes a switching lid and reference numeral 250 denotes a lid holding frame.

The developer container 38 is inserted and loaded into the image forming apparatus from the side of the end flange 201 as a user holds the holding handle 203 with a shaft direction in a horizontal direction. When the rotor 211 connected with the driving shaft of the external driving source of the image forming apparatus is rotated, the agitator 210 is accordingly rotated to agitate the developer accommodated in the container body 200 and the agitated developer is sent to the discharge opening 220 from which the developer is discharged to be supplied to the developing unit of the image forming apparatus.

It is common for such a developing container 38 to be stored in an office or the like in which the image forming apparatus is installed with the developer container 38 packed in a package container. The reason why the developer container 38 is not stored in a state where it is taken out of its packaging is to prevent the developer container 38 from being contaminated, deteriorating due to light, or broken and to prevent its appearance from being spoiled when stored in an office or the like. In addition, when the developer of the developer container 38, which is loaded and being used in the image forming apparatus, is exhausted, a new developer container 38 is taken out of the package container and is loaded into the image forming apparatus.

In order to store the developer container 38 in an office or the like, since the developer container 38 and the package container are elongated, it is convenient to erect the developer container 38 and the package container on a floor or the like with their longitudinal direction in a vertical direction. This is because the developer container 38 and the package container can be accommodated in even a small space such as between a wall and furniture.

In this case, however, if the developer container 38 and the package container are accommodated with the discharge opening 220 side (end flange 201 side) at the bottom, the developer is condensed by its own weight at the discharge opening 220 side with time. When the developer container 38 is loaded into the image forming apparatus and is used under this condition, a torque of the rotor 211 is increased, which may result in defects in the conveyance of the developer. This is because the condensed developer may be additionally input to the discharge opening 220 side irrespective of the condensation of developer at the discharge opening 220 side.

In order to avoid this, it is required to store the developer container 38 under the condition where there is no condensation of the developer at the discharge opening 220 side.

In addition, it is preferable to break down the condensed developer before the developer container 38 is loaded into the image forming apparatus and is used.

In order to realize this, it may be envisaged that the developer container 38 and the package container are not stored with the discharge opening 220 side at the bottom or a message is showed which indicating shaking of the developer container 38 before loading and use in the image forming apparatus, but it cannot be ascertained that this is faithfully performed in each office.

Hereinafter, the package container of the developer container 38 to allow for alleviating such inconvenience will be described.

Figure 7:
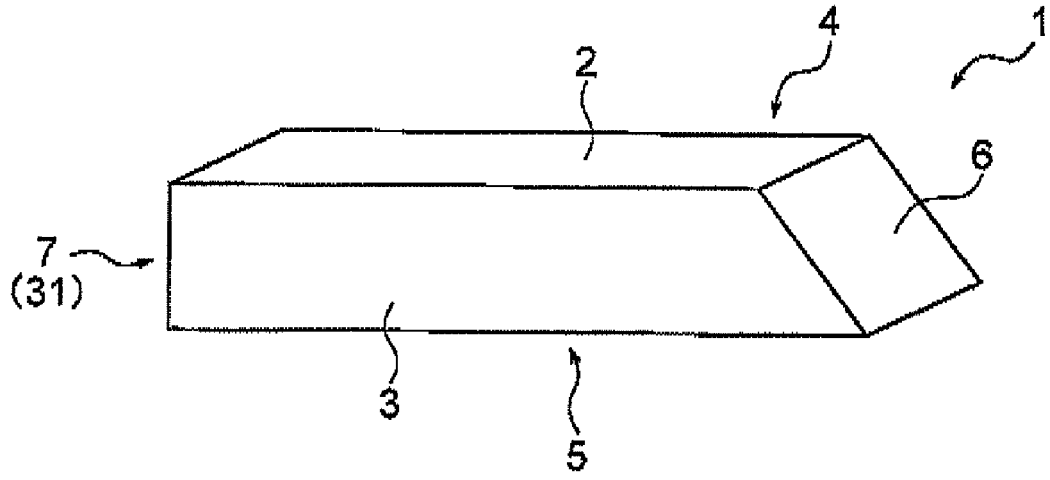
FIG. 7 is a perspective view of a developer container according to one embodiment of the present invention.
Figure 8:
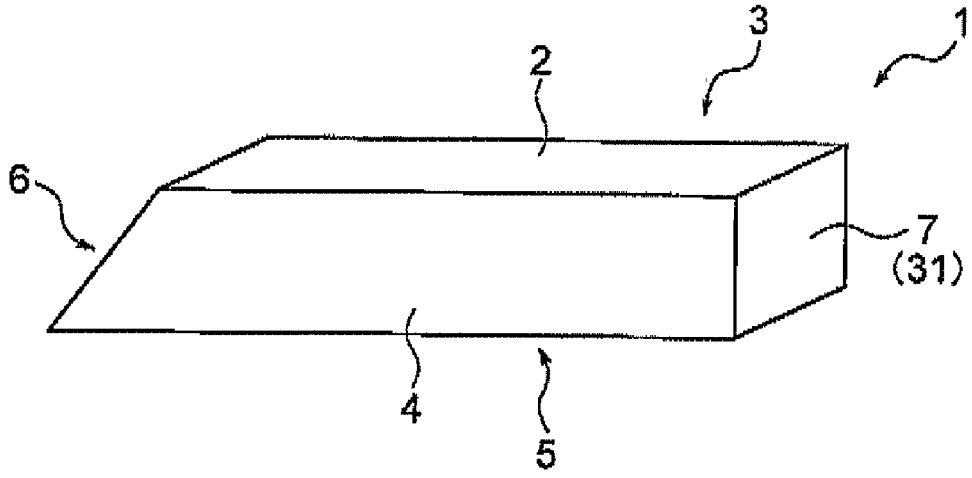
FIG. 8 is a perspective view of a developer container according to one embodiment of the present invention.
Figure 9:
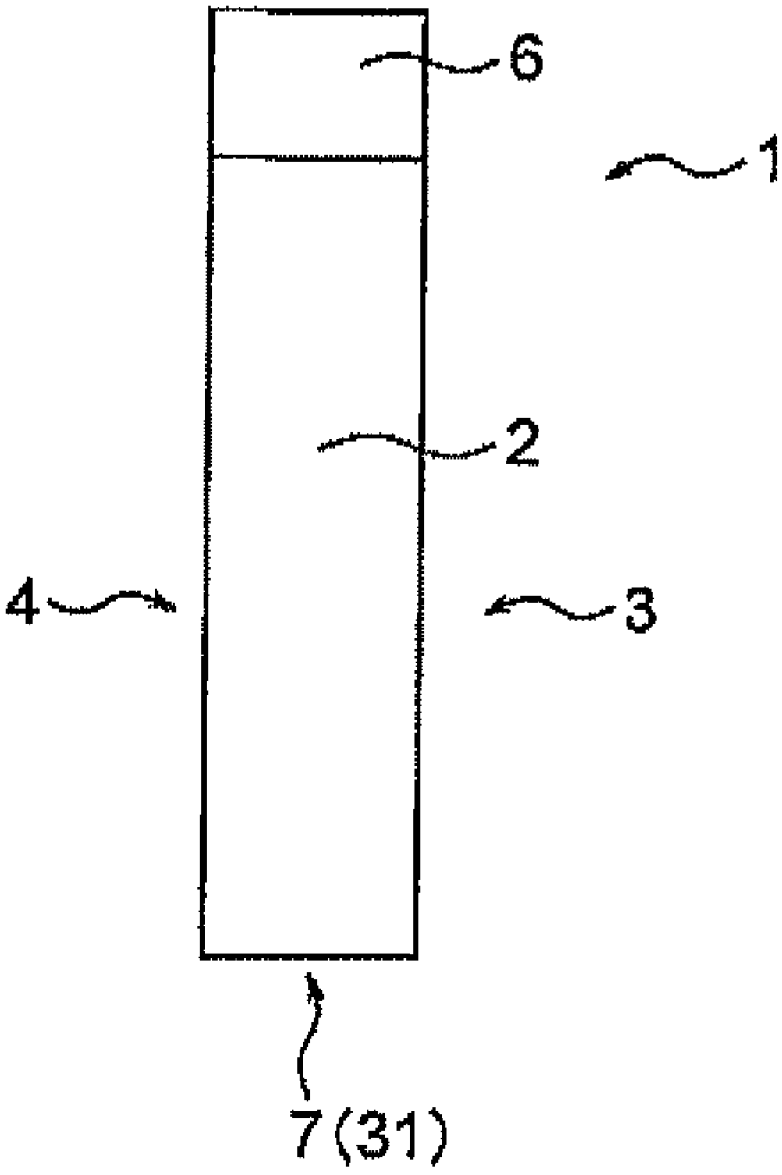
FIG. 9 is a front view of a developer container according to one embodiment of the present invention.
Figure 10:
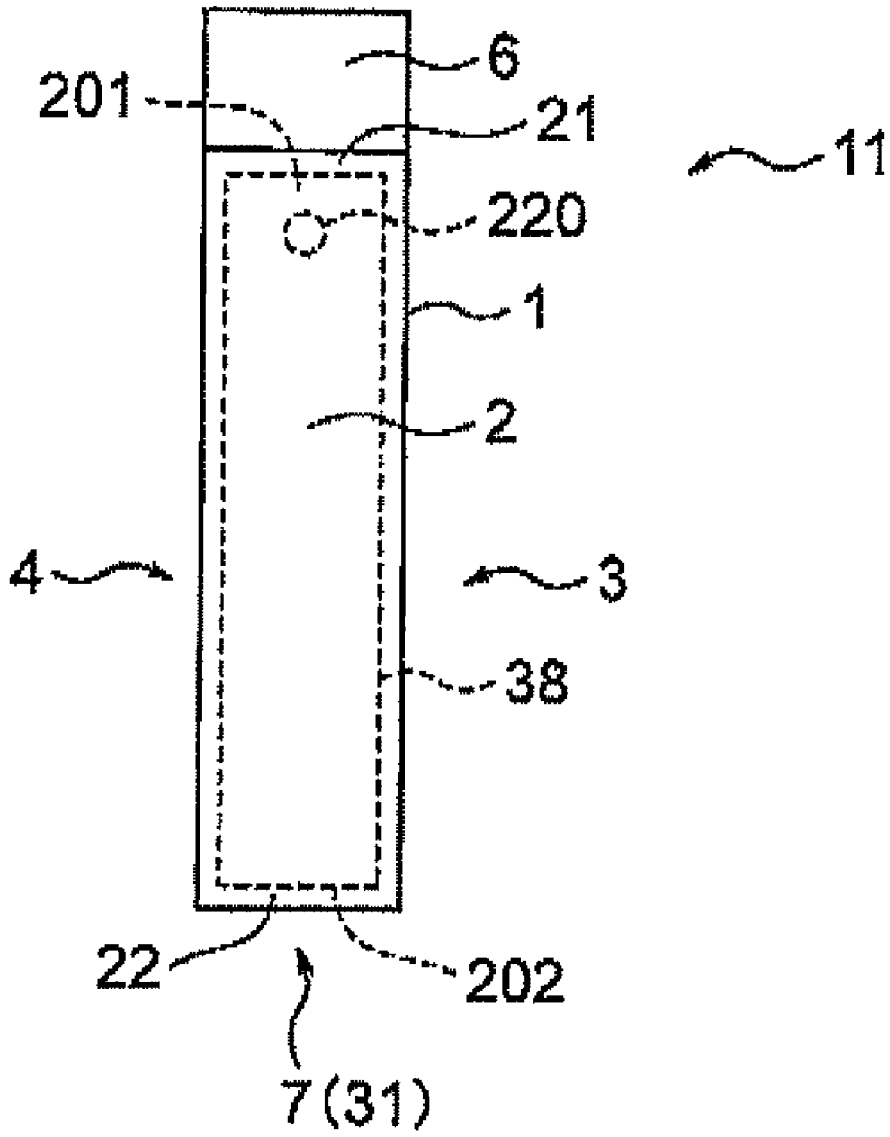
FIG. 10 is a front view of a developer container package body according to one embodiment of the present invention.

FIGS. 7 and 8 are perspective views of the package container. FIG. 9 is a front view thereof. FIG. 10 is a front view of a developer container package body.

A package container 1 is an elongated hexahedral box made of corrugate cardboard or the like. Its exterior includes four rectangular lateral sides 2 to 5, a top side 6 constituting one longitudinal end, and a bottom side 7 constituting the other longitudinal end. Thus, a developer container package body 11 is achieved by packaging the developer container 38 in the package container 1 with the longitudinal direction of the package container 1 in a longitudinal direction.

The top side 6 forms an obtuse angle with the lateral side 2 and an acute angle with the lateral side 5, thereby making an end portion 21 of the top side 6 of the package container 1 tapered. The bottom side 7 forms substantially a right angle with any of the lateral sides 2 to 5. Therefore, under the state of the developer container package body 11 where the developer container 38 is accommodated in the package container 1, at least in a case where the developer container package body 11 is stood up on a horizontal plane, the developer container package body 11 will not fall over because of its lowered center of gravity with the bottom side 7 at the bottom and with the longitudinal direction in a vertical direction. On the contrary, if the developer container package body 11 is intended to be stood up on the horizontal plane with the top side 6 at the bottom and with the longitudinal direction in the vertical direction, its center of gravity is not lowered and accordingly the developer container package body 11 will fall over. That is, although the developer container package body 11 may be stood up with the bottom side 7 at the bottom, it cannot be stood up with the top side 6 at the bottom. Accordingly, the developer container package body 11 has to be stood up with the bottom side 7 at the bottom in order to store the developer container package body 11 with the longitudinal direction in the vertical direction.

In addition, with the discharge opening 220 side (end flange 201 side) at the top (toward the end portion 21 side) and with the end flange 202 side at the bottom (toward the end portion 22 side), the developer container 38 is accommodated in the developer container package body 11 stood up with the bottom side 7 at the bottom.

Therefore, inside of the developer container 38 which is stored in this state for a significant length of time, there will be no condensation of the developer at the discharge opening 220 side (end flange 201 side) and there will be condensation of due to the weight of the developer itself at the end flange 201 side.

Figure 11:
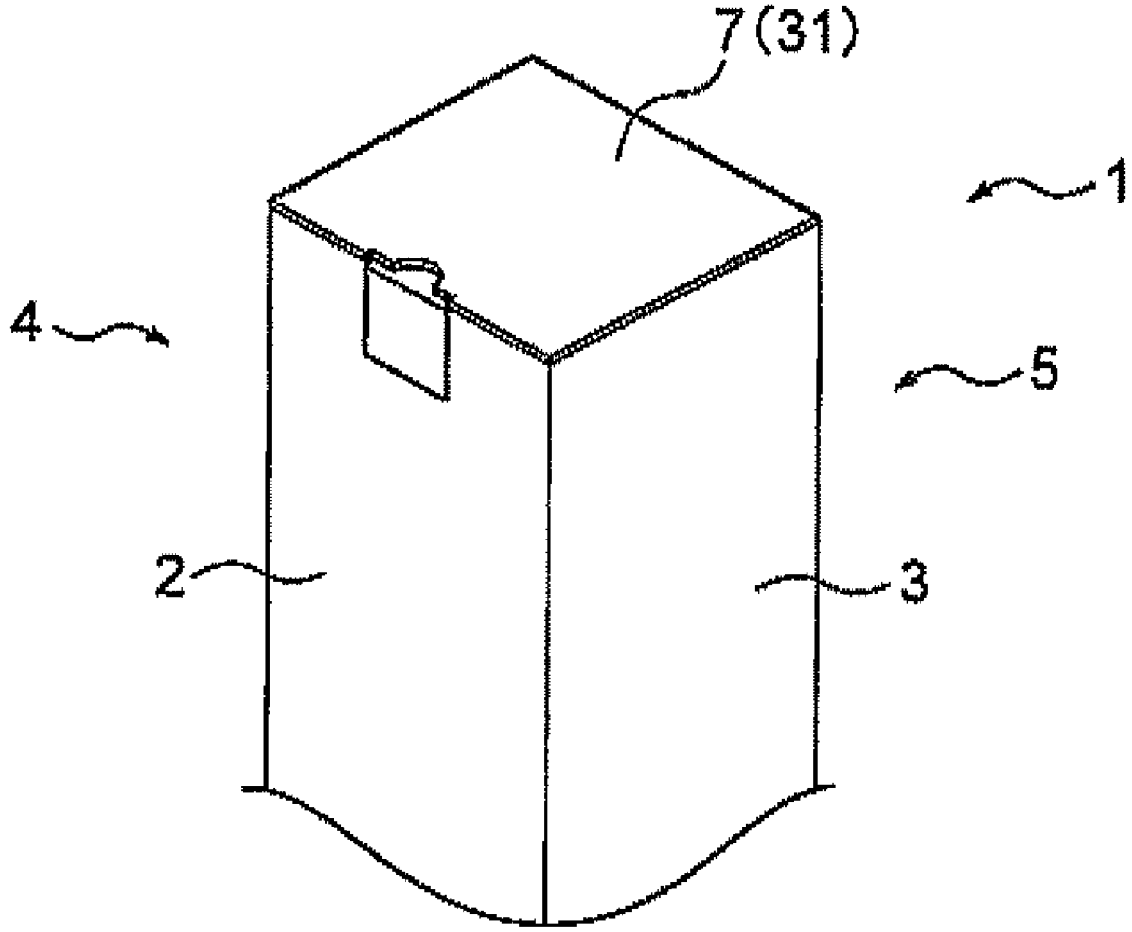
FIG. 11 is a perspective view of an end portion of a bottom side according to one embodiment of the present invention.
Figure 12:
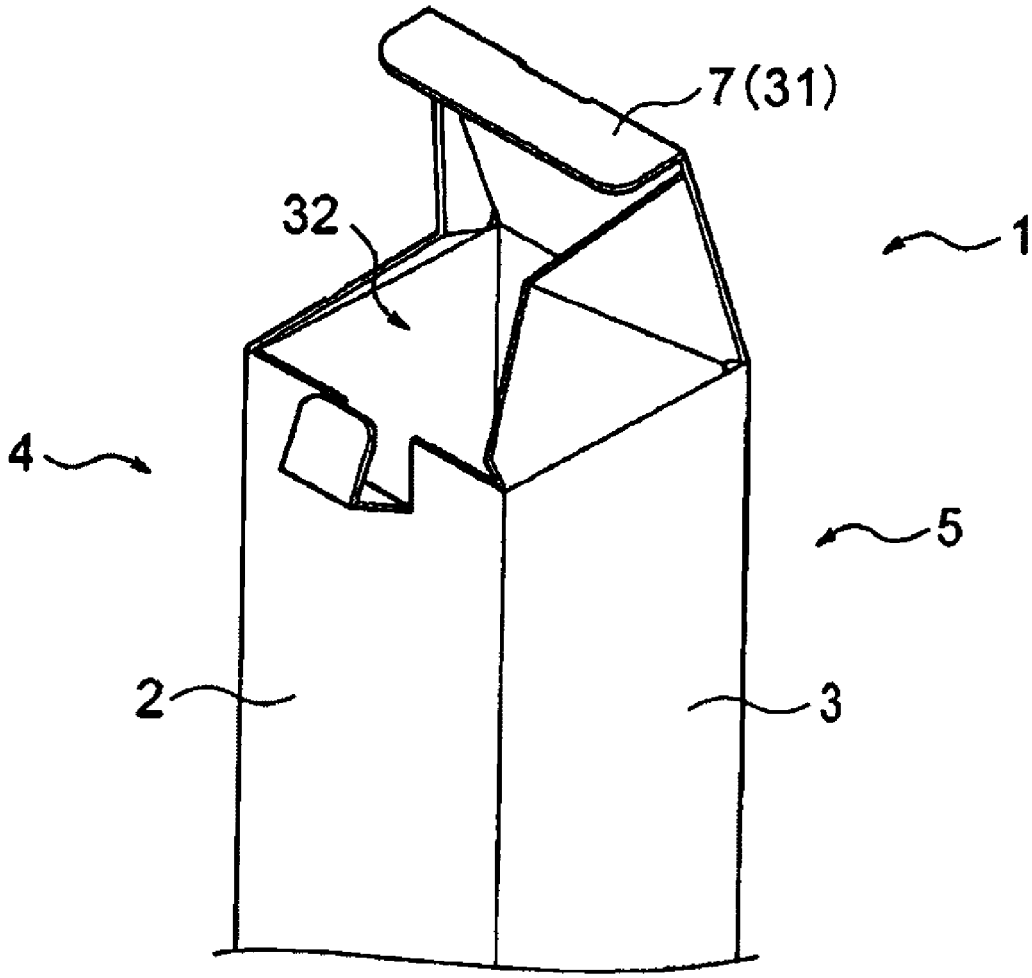
FIG. 12 is a perspective view of an end portion of a bottom side according to one embodiment of the present invention.

FIGS. 11 and 12 are perspective views of an end portion 22 of the bottom side 7.

The bottom side 7 serves as a switching lid 31 of the package container 1. When the switching lid 31 is opened, an opening 32 as a taking-out hole appears and the developer container 38 can be taken out of the opening 32.

In this case, since the developer container package body 11, which is stored in the state where it is stood up as described above, is stood up with the switching lid 31 as the bottom side 7 at the bottom, if the switching lid 31 is opened to take the developer container 38 out of the package container 1, the switching lid 31 is emptied from this state with the longitudinal direction of the developer container package body 11 substantially horizontal or, in many cases, with the top side 6 at the bottom and the bottom side 7 at the top. This is because it is difficult to take out the developer container 38 with the switching lid 31 as the bottom side 7 at the bottom and the developer container 38 may escape from the opening 32 and be broken by collision with a floor. Accordingly, it can be expected that this operation shakes the developer container 38 and the internal developer is broken up even if there is condensation of the developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container package body comprising:

a developer container that accommodates a developer; and a package container that packages the developer container and that has a first end side in a longitudinal direction of the package container and a second end side in the longitudinal direction of the package container, wherein the second end side differs from the first end side and is not parallel to the first end side, wherein, with the developer container accommodated in the package container, the package container is able to be stood up on a horizontal plane with the first end side at the bottom, and is not able to be stood up on the horizontal plane with the second end side at the bottom, wherein the developer container includes:

an accommodating part which accommodates the developer therein;

a conveying unit which conveys the developer contained in a body of the developer container as the conveying unit is rotated; and a discharging port which is provided in a downstream side of a conveyance direction of the conveying unit in a longitudinal direction of the developer container body, and which discharges the developer out of the accommodating part, and wherein a side which has the discharging port of the developer container is located at the second end side of the package container and a side which does not have the discharging port of the developer container is located at the first end side of the package container.

2. The developer container package body according to claim 1, wherein the package container further includes a taking-out hole which takes out the developer container at the first end side of the package container.

3. The developer container package body according to claim 1, wherein the first end side of the package container forms substantially a right angle with a first lateral side of the package container and forms substantially a right angle with a second lateral side of the package container, and wherein the second end side of the package container forms an obtuse angle with the first lateral side of the package container and forms an acute angle with the second lateral side of the package container.

4. A package container comprising:

a package container body that packages a developer container and that has a first end side in a longitudinal direction of the package container body and a second end side in the longitudinal direction of the package container body, wherein the second end side differs from the first end side and is not parallel to the first end side; and a taking-out hole that is provided in the package container body and takes the developer container out of the package container body, wherein the developer container includes:

an accommodating part which accommodates a developer therein;

a conveying unit which conveys the developer contained in a developer container body as the conveying unit is rotated; and a discharging port which is provided in a downstream side of a conveyance direction of the conveying unit in a longitudinal direction of the developer container body, and which discharges the developer out of the accommodating part, wherein, with the developer container accommodated in the package container body, the package container body is able to be stood up on a horizontal plane with the first end side at the bottom, and is not able to be stood up on the horizontal plane with the second end side at the bottom, and wherein a side which has the discharging port of the developer container is located at the second end side of the package container body and a side which does not have the discharging port of the developer container is located at the first end side of the package container body.

5. The package container according to claim 4, wherein the taking-out hole is provided at the first end side of the package container body.

6. The package container according to claim 4, wherein the first end side of the package container body forms substantially a right angle with a first lateral side of the package container body and forms substantially a right angle with a second lateral side of the package container body, and wherein the second end side of the package container body forms an obtuse angle with the first lateral side of the package container body and forms an acute angle with the second lateral side of the package container body.

* * * * *